US005341659A

United States Patent [19]

Wright

[11] Patent Number: 5,341,659

[45] Date of Patent: Aug. 30, 1994

[54] MULTI-STRAND JEWELRY CLASP

[76] Inventor: Marilyn P. Wright, 247 Watson Blvd., Pittsburgh, Pa. 15214

[21] Appl. No.: 86,659

[22] Filed: Jul. 6, 1993

[51] Int. Cl.[5] ..... A44C 13/00

[52] U.S. Cl. ..... 63/2; 63/21; 24/573.5; 24/684

[58] Field of Search ..... 63/2, 21; 24/573.5, 24/601.5, 609, 684

[56] References Cited

U.S. PATENT DOCUMENTS

| | | | |
|---|---|---|---|
| D. 253,094 | 10/1979 | Gudell . | |
| D. 258,278 | 2/1981 | Loiseau . | |
| D. 264,828 | 6/1982 | Gray . | |
| 1,578,940 | 3/1926 | Wacha | 63/21 |
| 2,586,758 | 2/1952 | Zerr | 63/2 |
| 2,598,597 | 5/1952 | Philippe | 63/2 |
| 3,098,364 | 7/1963 | Verri | 63/2 |
| 3,135,031 | 6/1964 | Brosse | 63/2 |
| 3,208,238 | 9/1965 | Spitzer | 63/2 |
| 4,527,316 | 7/1985 | Murphy | 63/2 |
| 4,530,221 | 7/1985 | Weinberg | 63/2 |

*Primary Examiner*—Peter M. Cuomo
*Assistant Examiner*—Michael Milano
*Attorney, Agent, or Firm*—Armstrong, Westerman, Hattori, McLeland & Naughton

[57] ABSTRACT

A multi-strand jewelry clasp comprises a pair of clasp connector boxes in each of which is provided a plurality of pivot hooks and rings for detachable connection to one end of each of a plurality of jewelry strands, such as chains or necklaces. A single latch arm is provided for detachably connecting together, in one operative step, the pair of clasp connector boxes and thus the plurality of strands.

5 Claims, 2 Drawing Sheets

MULTI-STRAND JEWELRY CLASP

BACKGROUND OF THE INVENTION

1. Field of the Invention

This invention relates to jewelry clasps, and more particularly, to clasps for connecting a plurality of strands such as chains or necklaces worn about the neck, wrist or ankle.

2. Description of Related Art

The prior art is replete with showings of various forms of jewelry clasps for fastening different types of jewelry, such as chains or necklaces about the neck of a wearer. An example is U.S. Pat. No. Des. 253,094 which shows a spring-type clasp comprising a spring latch and a bar or receptacle for receiving and holding the latch. U.S. Pat. No. Des. 258,278 shows another type of clasp in which a barrel type fastener bar is slidably mounted in a first hollow sleeve and reciprocably movable into and out of engagement with a second hollow sleeve in order to lock in place an attachment to a piece of jewelry. U.S. Des. Pat. No. 264,828 shows a clasp wherein a spring lock, attachable to a piece of jewelry, is disposable inside a generally rectangular holder to hold the jewelry in place. United Kingdom Patent No. 190,828 shows a spring steel strap formed into a loop for attaching the ends of a strap such as a watch strap. United Kingdon Patent No. 649,367 shows hook-type fasteners for wearing apparel.

It is fairly common practice to wear a number of necklaces or chains, especially about the neck. The two-piece clasp mechanisms for connecting the ends of such strands generally are small and it is difficult to connect the clasp parts together. This difficulty and the time involved are increased in proportion to the number of strands worn at one time.

To the best of my knowledge, there are no means known to to the art to simultaneously connect a plurality of two piece strand clasps.

SUMMARY OF THE INVENTION

The present invention provides two clasp boxes in each of which are mounted a plurality of pivot hooks and rings for removably connecting, in each box, an end of a strand such as a chain or a necklace. According to the invention, the two boxes then are removably connected together by means of a single latch mechanism, thus effectively connecting, with a single latching step, the ends of the plurality of strands which are affixed to the pivot hooks in the respective clasp boxes.

DESCRIPTION OF THE PREFERRED EMBODIMENTS

Figure 1:
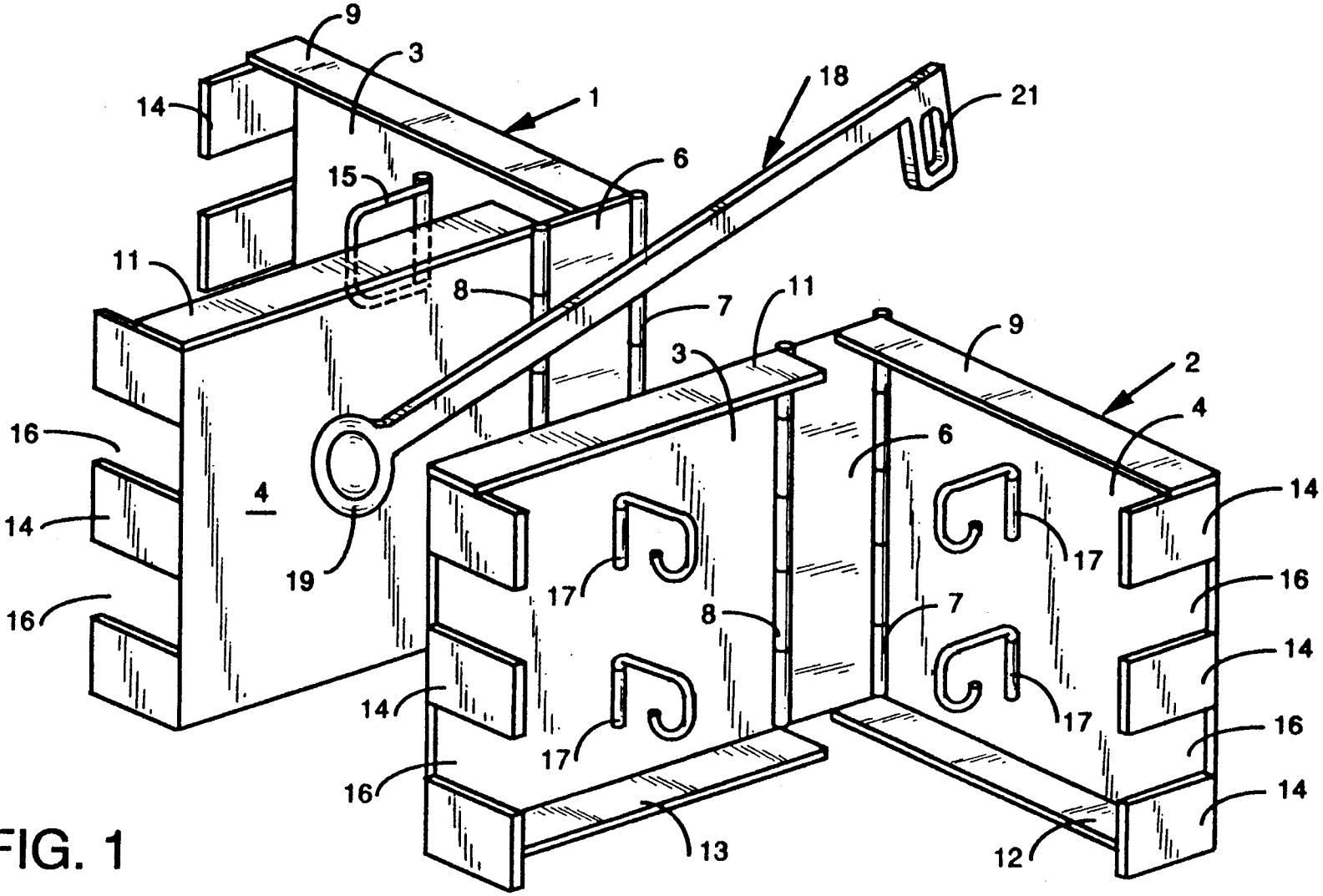
FIG. 1 is an isometric view of the clasp boxes of the invention and showing a latch arm pivotally connected to the outside of one of the boxes.

Referring to FIG. 1, there are shown a pair of clasp boxes denoted generally by the numerals 1 and 2. Each of the boxes 1 and 2 comprises side walls 3 and 4. Each pair of side walls 3, 4 are connected, through end walls

6, by a pair of piano hinges 7, 8. Top walls 9, 11 enclose the tops of the boxes and bottom walls 12, 13 enclose the bottoms of the boxes. The ends of the side walls 3, 4 opposite the hinged edges of the side walls are provided with a plurality of snap tabs 14 which, on closing the boxes, hold the side walls 3, 4 together by a friction fit of the snap tabs, and leave open gaps 16 between each pair of adjacent snap tabs. In the embodiment illustrated in FIG. 1, there are three snap tabs and two gaps at each unhinged end of side walls 3 and 4.

Each of the side walls 3, 4 of one of the boxes, e.g. the right hand box 2 (FIG. 1), is provided with a number of pivot hooks 17, each of which is adapted to receive a ring-type element of a clasp mechanism of one end of a jewelry strand such as a necklace or chain. The other box, e.g. the left hand box 1, is provided with an equal number of pivot rings 15 adapted to receive the other end of the clasp mechanism of a jewelry strand. In FIG. 1, two pivot hooks are shown mounted on each of the side walls 3, 4 of right hand box 2, but it is to be understood that any reasonable number of pivot hooks, and a corresponding number of pivot rings, may be provided to accommodate a large number of strands, for example, from two to eight or more. Each strand extends from a pivot hook or pivot ring, through a gap 16, to the outside of the boxes 1, 2.

Figure 2:
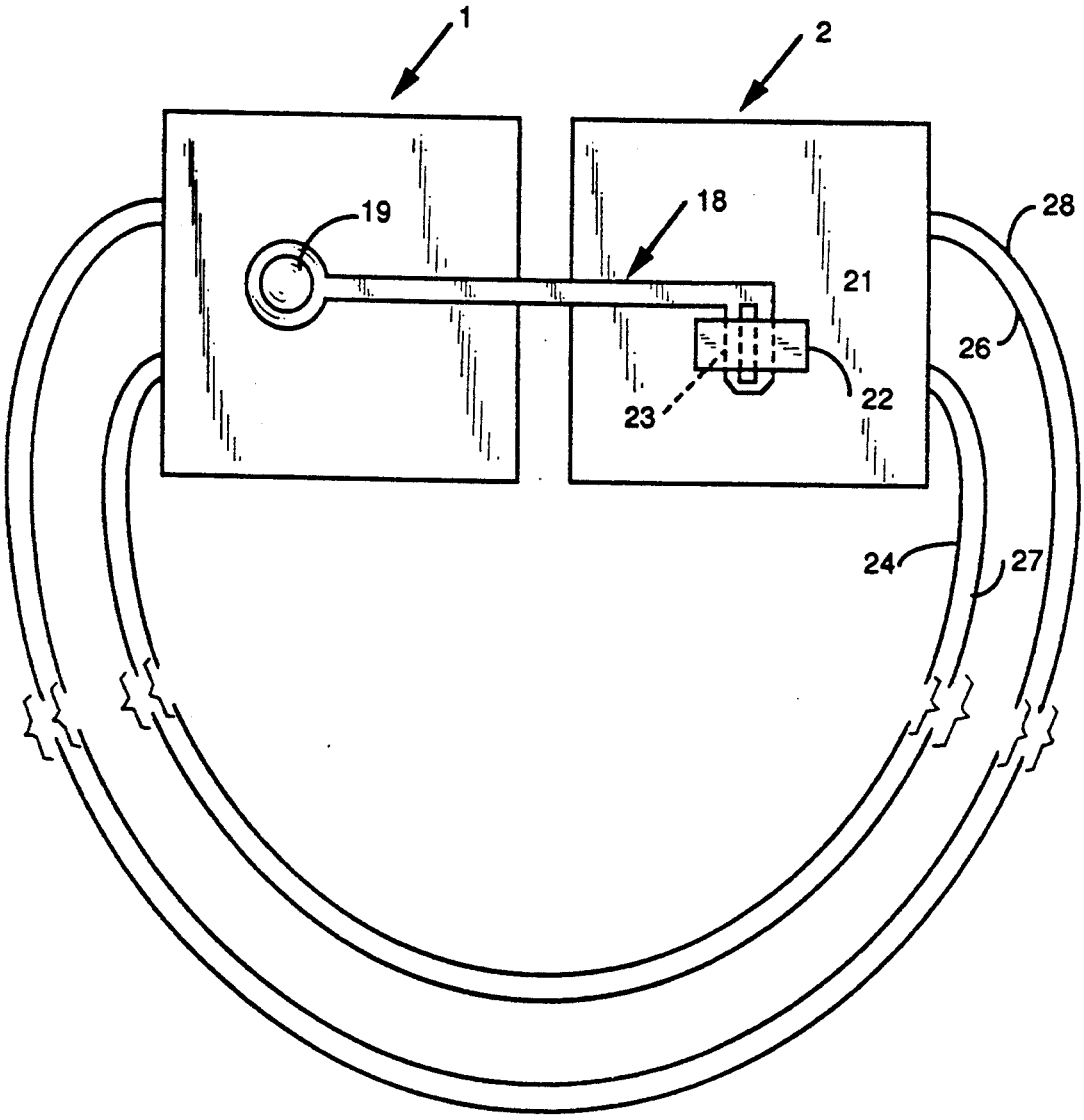
FIG. 2 is an elevational view of the clasp boxes connected together by the latch arm on one box extending into a latch bar mounted on the outside of ther other clasp box, and a plurality of strands having the ends thereof connected to the pivot hooks and rings inside each of the respective clasp boxes.

As also shown in FIG. 1, one of the boxes, for example, the left hand box 1 in FIG. 1, is provided with a latch arm denoted generally by the numeral 18, pivotable movable about pivot 19 mounted on the outside of the box 1. Latch arm 18 is provided with a spring latch 21 projecting from the arm 18 and, as shown in FIG. 2, adapted to extend into and connect the latch arm to a latch bar 22 mounted on the outside of the other clasp box, as right hand box 2. Latch bar 22 has an opening 23 for reception of the spring latch 21 to hold the latch arm in place, connecting the two clasp boxes 1, 2 and forming closed strand loop(s).

As also shown in FIG. 2, a plurality of strands, 24, 26, 27 and 28, extend from gaps 16 and about the neck of the wearer. Any reasonable number of strands may be so mounted, normally up to about eight or so. Being detachably mounted on hooks 17 and rings 15, strands may be replaced with other strands or additional strands added, thus enhancing the wearer's choice of strands to be worn on any particular occasion.

The described multi-strand clasp serves effectively to keep a plurality of strands, such as chains or necklaces, in an orderly arrangement, without entanglement with each other. More importantly, the inventive device permits easy connection of a multitude of strands in one easy step, i.e. simply by connecting the latch arm 18 to the latch bar 22. The latter mechanism is larger than the usual clasp mechanisms used to connect together the ends of necklaces or chains and thus makes it easy for those of failing eyesight, or the elderly or those afflicted with arthritis to effect the closure. Removal of the plurality of strands is equally easy by simply disconnecting the single latch arm from the latch bar. For storage of the plurality of chains or necklaces without entangling, the clasp boxes can be reconnected and hung on a clothes hanger or other similar storage rack.

The multi-strand clasp of the invention can be easily produced from precious or other metals or from plastic, and may be colored in any desired color(s) or provided with desired indicia or inlaid with precious or semi-precious metal or gems. The inside surfaces of side walls 3, 4 can be covered with a soft material, such as felt, in order to prevent scratching or other marring of valuable chains or necklaces.

Obviously, other means can be used to connect the clasp boxes, for example, a latch arm having a hook and a latch bar comprising a corresponding eye mechanism. Means other than hooks, such as rings, can be used as connectors for connecting the ends of the strands to the clasp boxes.

What is claimed is:

1. A multi-strand jewelry clasp comprising:

a pair of clasp boxes each comprising a pair of side walls and an end wall hinged together at corresponding opposed edges thereof and, in a closed position of the side walls, defining an interior space;

a plurality of pivot hooks mounted on an interior surface of each side wall of one of the clasp boxes and a plurality of pivot rings mounted on an interior surface of each side wall of the other clasp box, said pivot hooks and said pivot rings projecting into said interior space and respectively adapted to receive one piece of a two-piece clasp mechanism of a jewelry strand;

a plurality of snap tabs extending from unhinged edges of the side walls of each of said clasp boxes in the direction of said interior space and, in a closed position of each clasp box, defining between adjacent snap tabs a gap for exit of a strand from the interior space of the box;

a latch arm pivotally mounted on an exterior surface of one of the side walls of one of said clasp boxes, and a latch bar mounted on an exterior surface of one of the side walls of the other of said clasp boxes and adapted to receive and hold said latch arm to detachably connect the two clasp boxes together.

2. A jewelry clasp comprising a pair of clasp connector boxes, a plurality of pivot hooks mounted inside one connector box, a plurality of pivot rings mounted inside the other connector box, said pivot hooks and said pivot rings respectively adapted to receive and detachably hold one end of each of a plurality of jewelry strands, a latch arm pivotably connected at one end to an outside surface of one of said connector boxes and having a spring latch at the other end of said latch arm, and a latch bar on an outside surface of the other connector box and adapted to receive said spring latch to detachably connect the connector boxes together.

3. A jewelry clasp comprising a pair of clasp connector boxes each comprising a pair of side walls each having an inside surface, a plurality of pivot hooks mounted on the inside surface of the side walls on one connector box and a corresponding plurality of pivot rings mounted on the inside surface of the side walls of the other connector box, an end wall hingedly connected to the side walls along opposed edges of one end of each side wall, and a plurality of snap tabs extending from an unhinged edge of each side wall and, in a closed position of each connector box, serving to frictionally hold the side walls together and defining between each pair of adjacent snap tabs a gap for exit of strands from the connector box, and means to detachably fasten together the pair of clasp connector boxes.

4. A clasp in accordance with claim 3, wherein one of the clasp connector boxes is provided with a latch arm pivotally connected to an outside surface on one side wall, a spring latch on a free end of the latch arm, and a latch bar mounted on an outside surface of one side wall of the other connector box and adapted to receive the spring latch to detachably fasten the clasp connector boxes together.

5. A method of mounting a plurality of jewelry strands for wearing by a user, comprising detachably connecting one end of each of a plurality of jewelry strands to a hook pivotally mounted inside one of a pair of connector boxes, detachably connecting the other end of each of the plurality of jewelry strands to a ring pivotally mounted inside the other of said pair of connector boxes, and detachably connecting together the connector boxes by means of a single latch arm mounted on one connector box and detachably secured in one securement step to a latch bar mounted on the other connector box.

* * * * *